US012270390B2

(12) United States Patent
Fujii et al.

(10) Patent No.: US 12,270,390 B2
(45) Date of Patent: Apr. 8, 2025

(54) ELECTRIC COMPRESSOR

(71) Applicant: KABUSHIKI KAISHA TOYOTA JIDOSHOKKI, Kariya (JP)

(72) Inventors: Akio Fujii, Aichi-ken (JP); Shumpei Yamakage, Aichi-ken (JP); Hiroaki Ito, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 51 days.

(21) Appl. No.: 17/993,354

(22) Filed: Nov. 23, 2022

(65) Prior Publication Data

US 2023/0167815 A1 Jun. 1, 2023

(30) Foreign Application Priority Data

Nov. 26, 2021 (JP) ..... 2021-191859

(51) Int. Cl.
*F04B 39/12* (2006.01)
*F04B 35/04* (2006.01)

(52) U.S. Cl.
CPC ..... *F04B 39/121* (2013.01); *F04B 35/04* (2013.01)

(58) Field of Classification Search
CPC ..... F04B 35/04; F04B 39/121
USPC ..... 174/84 R, 88, 540, 50.6, 50.57; 277/314, 277/602, 626, 607
See application file for complete search history.

(56) References Cited

U.S. PATENT DOCUMENTS 5,453,579 A * 9/1995 Cohea ..... H02G 3/083 174/152 G
5,701,634 A * 12/1997 Uemura ..... F16L 5/10 174/152 G
6,081,964 A * 7/2000 Mori ..... B60R 16/0222 16/2.2

(Continued)

FOREIGN PATENT DOCUMENTS

JP 35-7985 Y 4/1960
JP 11-69572 A 3/1999

(Continued)

OTHER PUBLICATIONS

Communication dated Jul. 30, 2024, issued in Japanese Application No. 2021-191859.

*Primary Examiner* — Christopher S Bobish
(74) *Attorney, Agent, or Firm* — Sughrue Mion, PLLC

(57) ABSTRACT

An electric compressor includes: a compression mechanism; a motor mechanism; an inverter; a housing accommodating the compression mechanism, the motor mechanism, and the inverter; and a power supplier. The power supplier includes a connector and a cable extending toward an outside of the housing. The connector includes a first protrusion extending toward the outside of the housing. The first protrusion includes an end surface that has an insertion hole into which the cable is inserted, and a side surface that cylindrically extends and is connected to the end surface. A second protrusion is formed integrally with the side surface and extends downward from the side surface in a gravity direction corresponding to a direction in which the gravity is applied to the housing. A water droplet having reached the insertion hole along the cable is guided from the insertion hole to the second protrusion along the end surface.

5 Claims, 6 Drawing Sheets

(56) References Cited

U.S. PATENT DOCUMENTS 6,547,255 B1 * 4/2003 Donaway ..... F16L 19/0212 277/626
6,708,366 B2 * 3/2004 Ono ..... B60R 16/0222 16/2.5
6,995,316 B1 * 2/2006 Goto ..... H02G 15/013 174/152 G
6,995,317 B1 * 2/2006 Dzurilla ..... B60R 16/0222 174/152 G
8,441,160 B2 * 5/2013 Watanabe ..... H02M 7/003 310/71
8,835,778 B2 * 9/2014 Matsumoto ..... H02G 3/22 174/152 G
8,981,228 B2 * 3/2015 Okuhara ..... B60R 16/0222 174/152 G
9,425,597 B2 * 8/2016 Suzuki ..... B60R 16/0222
10,556,283 B2 * 2/2020 Maxted ..... B23K 1/0008
11,099,335 B2 * 8/2021 De Jong ..... G02B 6/3893
11,242,016 B2 * 2/2022 Toyoda ..... B60R 16/0222
11,309,695 B2 * 4/2022 Laine ..... H02G 3/088
2013/0049550 A1 * 2/2013 Watanabe ..... F04B 39/121 310/67 R
2013/0285329 A1 * 10/2013 Sykes ..... F16L 5/10 277/606
2014/0158422 A1 * 6/2014 Fan ..... H02G 3/22 174/650
2019/0052070 A1 * 2/2019 Hattori ..... H02G 3/22

FOREIGN PATENT DOCUMENTS

JP 2011-163231 A 8/2011
JP 2016-067069 A 4/2016

* cited by examiner

ELECTRIC COMPRESSOR

BACKGROUND ART

Cross-Reference to Related Application

This application claims priority to Japanese Patent Application No. 2021-191859 filed on Nov. 26, 2021, the entire disclosure of which is incorporated herein by reference.

The present disclosure relates to an electric compressor.

Japanese Patent Application Publication No. 2011-163231 discloses a known electric compressor. This electric compressor includes a compression mechanism, a motor mechanism, an inverter, a housing, and a power supplier. The compression mechanism is configured to compress fluid having been drawn and discharge the compressed fluid. The motor mechanism is configured to drive the compression mechanism. The inverter controls and drives the motor mechanism. The housing accommodates the compression mechanism, the motor mechanism, and the inverter. The power supplier supplies electric power to the inverter. In Japanese Patent Application Publication No. 2011-163231, the fluid is refrigerant gas.

The power supplier includes a cable and a connector. The cable is connected to the inverter and extends toward an outside of the housing. The connector is fixed to the housing. The connector has an insertion hole into which the cable is inserted. The connector also has, in its inside, a grommet into which the cable is inserted.

In the above-described electric compressor, when the power supplier supplies the electric power to the inverter, the inverter controls and drives the motor mechanism. Thus, the compression mechanism is operated to start an air conditioner of a vehicle or the like. In the electric compressor, since the cable is inserted into the grommet, a water droplet such as rainwater hardly enter the housing from the insertion hole along the cable. This prevents the inverter from being damaged due to the water droplet in the electric compressor.

However, it is required to more suitably prevent the inverter from being damaged due to the water droplet. Then, a water stopper disclosed in Japanese Patent Application Publication No. 2016-67069 may be used for the electric compressor disclosed in Japanese Application Publication No. 2011-163231. That is, the water stopper is attached to the cable at an outside of the connector. As a result, the water droplet may be guided to the outside of the connector by the water stopper before the water droplet moves along the cable and reaches the insertion hole. Then, the water droplet hardly enters the housing from the insertion hole, which more suitably prevents the inverter from being damaged due to the water droplet.

However, using the water stopper increases the number of parts of the electric compressor. The water stopper needs to be attached to the cable, which also increases workloads for manufacturing the electric compressor. The above-described problems in this kind of electric compressor causes an increase in a manufacturing cost.

The present disclosure has been made in view of the above problems, and its objective is to provide an electric compressor capable of suitably preventing an inverter from being damaged due to a water droplet and suppressing an increase in a manufacturing cost.

SUMMARY

In accordance with an aspect of the present disclosure, there is provided an electric compressor including: a compression mechanism configured to compress fluid that is drawn and discharge the compressed fluid; a motor mechanism configured to drive the compression mechanism; an inverter configured to control and drive the motor mechanism; a housing accommodating the compression mechanism, the motor mechanism, and the inverter; and a power supplier configured to supply electric power to the inverter. The power supplier includes a connector fixed to the housing, and a cable that is connected to the inverter and extends toward an outside of the housing. The connector includes a first protrusion extending toward the outside of the housing. The first protrusion includes an end surface that has an insertion hole into which the cable is inserted, and a side surface that cylindrically extends and is connected to the end surface. A second protrusion is formed integrally with the side surface and extends downward from the side surface in a gravity direction corresponding to a direction in which the gravity is applied to the housing. A water droplet having reached the insertion hole along the cable is guided from the insertion hole to the second protrusion along the end surface.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

The following will describe a first embodiment and a second embodiment of the present disclosure with reference to the drawings. In each of the first and second embodiments, an electric compressor is mounted in a vehicle (not illustrated) and included in an air conditioner of the vehicle.

First Embodiment

Figure 1:
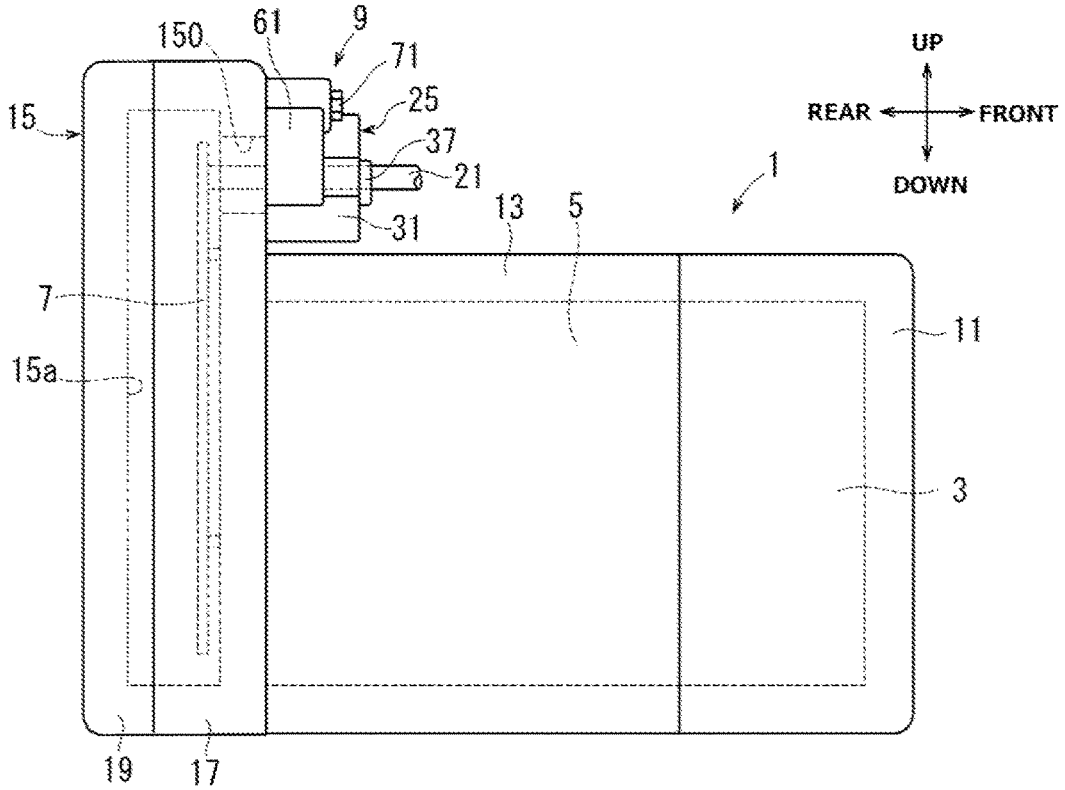
FIG. 1 is a side view of an electric compressor according to a first embodiment.
Figure 2:
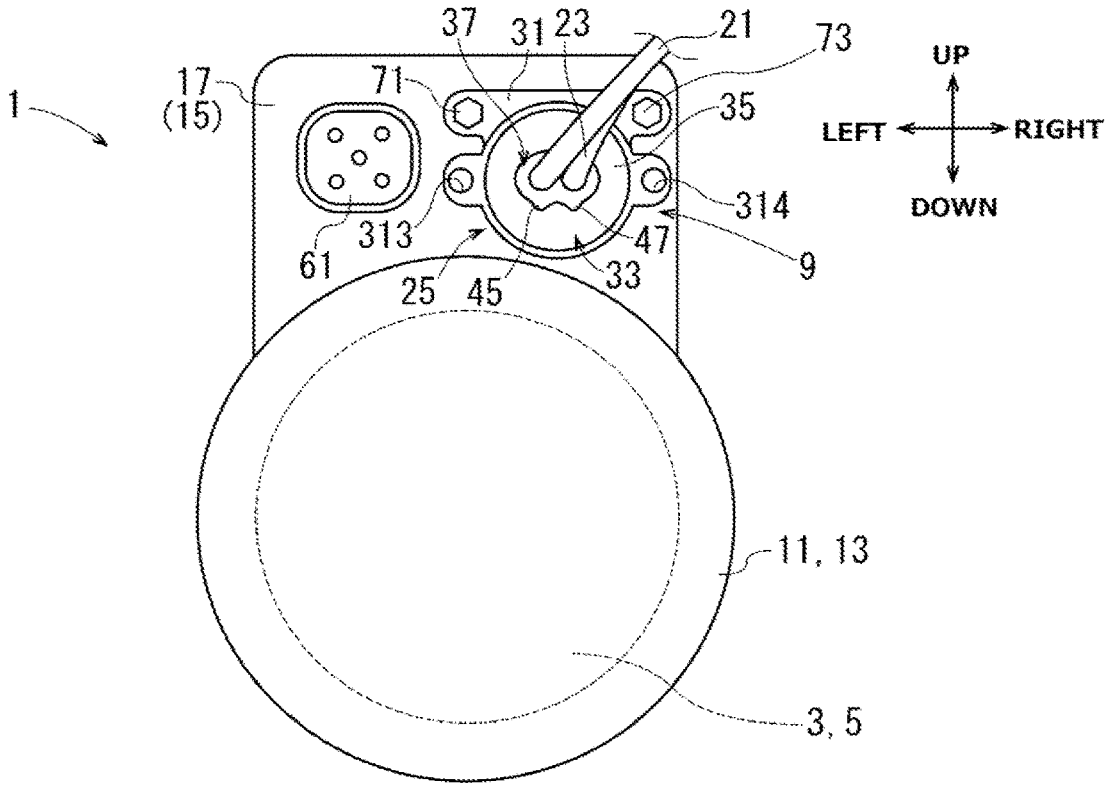
FIG. 2 is a front view of the electric compressor according to the first embodiment.

As illustrated in FIG. 1 and FIG. 2, the electric compressor of the first embodiment includes a housing 1, a compression mechanism 3, a motor mechanism 5, an inverter 7, and a power supplier 9.

Figure 3:
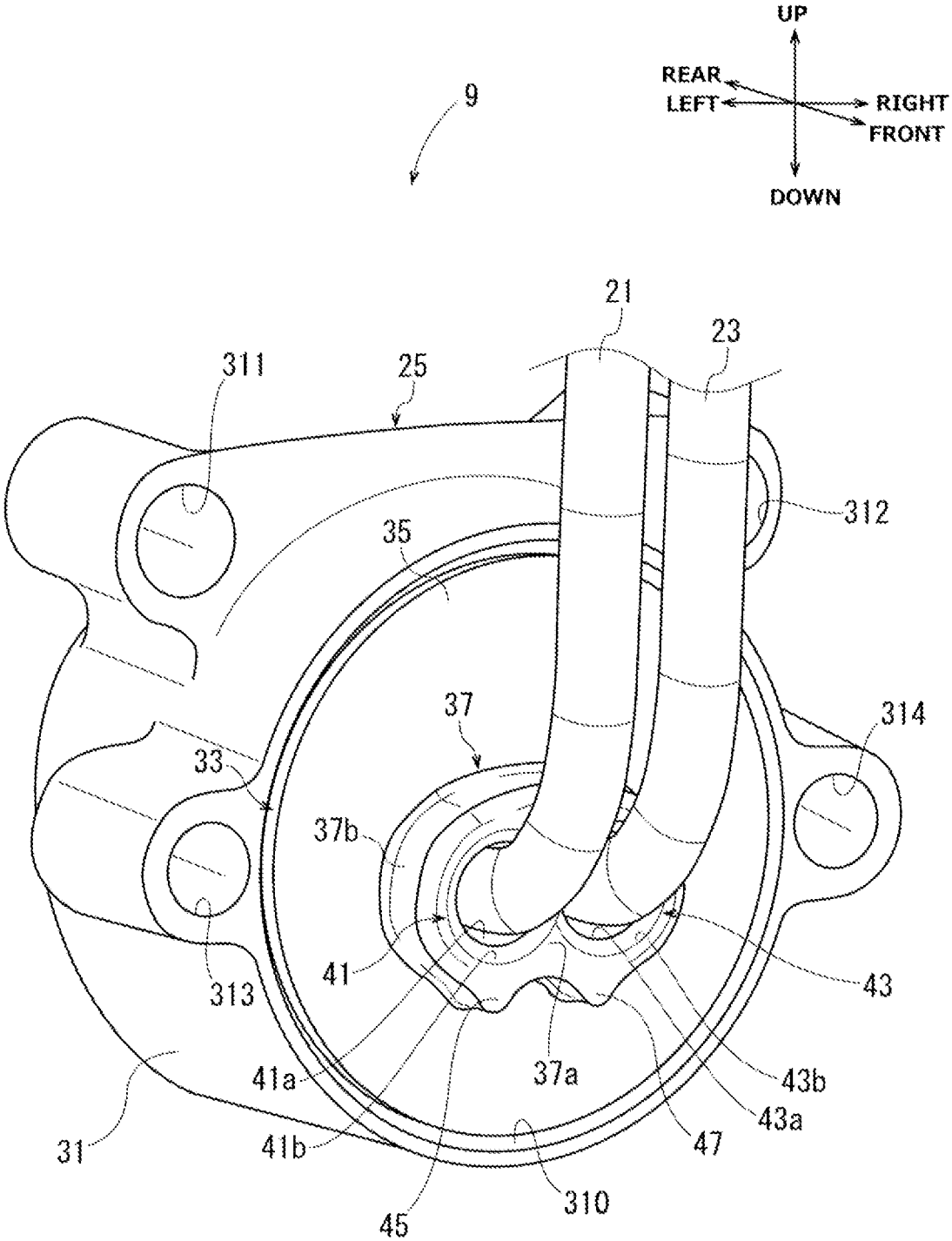
FIG. 3 is a perspective view of cables and a connector of the electric compressor according to the first embodiment.

In the present embodiment, solid arrows in FIG. 1 indicate a front-rear direction and an up-down direction of the electric compressor. Solid arrows in FIG. 2 indicate the up-down direction of the electric compressor corresponding to FIG. 1, and a right-left direction of the electric compressor. In FIG. 3 and thereafter, the front-rear direction, the up-down direction, and the right-left direction of the electric compressor correspond to those in FIG. 1 and FIG. 2.

The electric compressor of the present embodiment is mounted in an engine room of the vehicle with an upper side of the electric compressor oriented to an upper side of the vehicle. Thus, in the present embodiment, an up-to-down direction of the electric compressor corresponds to a "gravity direction" in the present disclosure. That is, the gravity is applied to the electric compressor including the housing 1 mounted in the engine room, in the up-to-down direction of the electric compressor.

The electric compressor of the present embodiment is mounted in a lower portion of the engine room. Specifically, the engine room accommodates a battery (not illustrated), and the electric compressor is disposed below the battery in the engine room. The electric compressor may be appropriately mounted at any position in the vehicle.

As illustrated in FIG. 1 and FIG. 2, the housing 1 includes a compressor housing 11, a motor housing 13, and an inverter box 15. The compressor housing 11, the motor housing 13, and the inverter box 15 are made of an aluminum alloy. The compressor housing 11, the motor housing 13, and the inverter box 15 are arranged in this order in the front-rear direction and are integrally assembled. The compressor housing 11 has an outlet and the motor housing 13 has an inlet, although the outlet and the inlet are not illustrated.

As illustrated in FIG. 1, the inverter box 15 includes a front case 17 adjacent to the motor housing 13, and a rear case 19 behind the front case 17. The front case 17 and the rear case 19 are connected to each other in the front-rear direction. Thus, an inverter chamber 15*a* is formed in the inverter box 15.

The front case 17 has a communication hole 150. Through the communication hole 150, the inverter chamber 15*a* is communicated with an outside of the front case 17, that is, an outside of the housing 1. A first power supply cable 21 and a second power supply cable 23, which will be described later, are inserted into the communication hole 150. As illustrated in FIG. 2, a control connector 61 is fixed to the front case 17.

As illustrated in FIG. 1, the compression mechanism 3 is a known scroll-type of compression mechanism. The compressor housing 11 accommodates the compression mechanism 3. Thus, a discharge chamber (not illustrated) is formed between the compression mechanism 3 and the compressor housing 11.

The motor housing 13 accommodates the motor mechanism 5. The motor mechanism 5 includes a stator, a rotor, and a drive shaft, which are not illustrated in detail. The motor mechanism 5 is connected to the compression mechanism 3 so as to transmit the power.

The inverter chamber 15*a* of the inverter box 15 accommodates the inverter 7. The inverter 7 is formed by a circuit board and a plurality of semiconductors provided on the circuit board, which are not illustrated in detail. The inverter 7 is electrically connected to the power supplier 9 and the control connector 61.

As illustrated in FIG. 3, the power supplier 9 includes a pair of the first power supply cable 21 and the second power supply cable 23, and a power supply connector 25. Each of the first power supply cable 21 and the second power supply cable 23 is an example of a "cable" of the present disclosure. The power supply connector 25 is an example of a "connector" of the present disclosure.

The first power supply cable 21 and the second power supply cable 23 are independent of each other. One end of each of the first power supply cable 21 and the second power supply cable 23 is electrically connected to the inverter 7 (see FIG. 1). The first power supply cable 21 and the second power supply cable 23 extend into the engine room, that is, extend toward the outside of the housing 1, and is electrically connected to the battery in the engine room. Specifically, the other end of the first power supply cable 21 is electrically connected to a positive electrode of the battery. The other end of the second power supply cable 23 is electrically connected to a negative electrode of the battery.

As illustrated in FIG. 3, the power supply connector 25 includes a case 31 and a cap 33. The case 31 is made of a resin and has a tubular shape extending in the front-rear direction. The case 31 has a mounting opening 310, a first mounting hole 311, a second mounting hole 312, a third mounting hole 313, and a fourth mounting hole 314. The mounting opening 310 extends through the case 31 in the front-rear direction.

The first mounting hole 311 and the second mounting hole 312 are formed in an upper portion of the case 31 and above the mounting opening 310. Specifically, the first mounting hole 311 is formed in an upper left end of the case 31, and the second mounting hole 312 is formed in an upper right end of the case 31. The third mounting hole 313 is formed below the first mounting hole 311. The fourth mounting hole 314 is formed below the second mounting hole 312. As a result, the third mounting hole 313 and the fourth mounting hole 314 are disposed in the right-left direction of the case 31 with the mounting opening 310 interposed therebetween. A bracket (not illustrated) holds the first power supply cable 21 and the second power supply cable 23 at an outside of the cap 33 and is attached to the third mounting hole 313 and the fourth mounting hole 314.

The cap 33 is made of a resin. The cap 33 has a main body 35 and a first protrusion 37. The main body 35 is fitted into the mounting opening 310, so that the cap 33 is fixed to the case 31.

Figure 6:
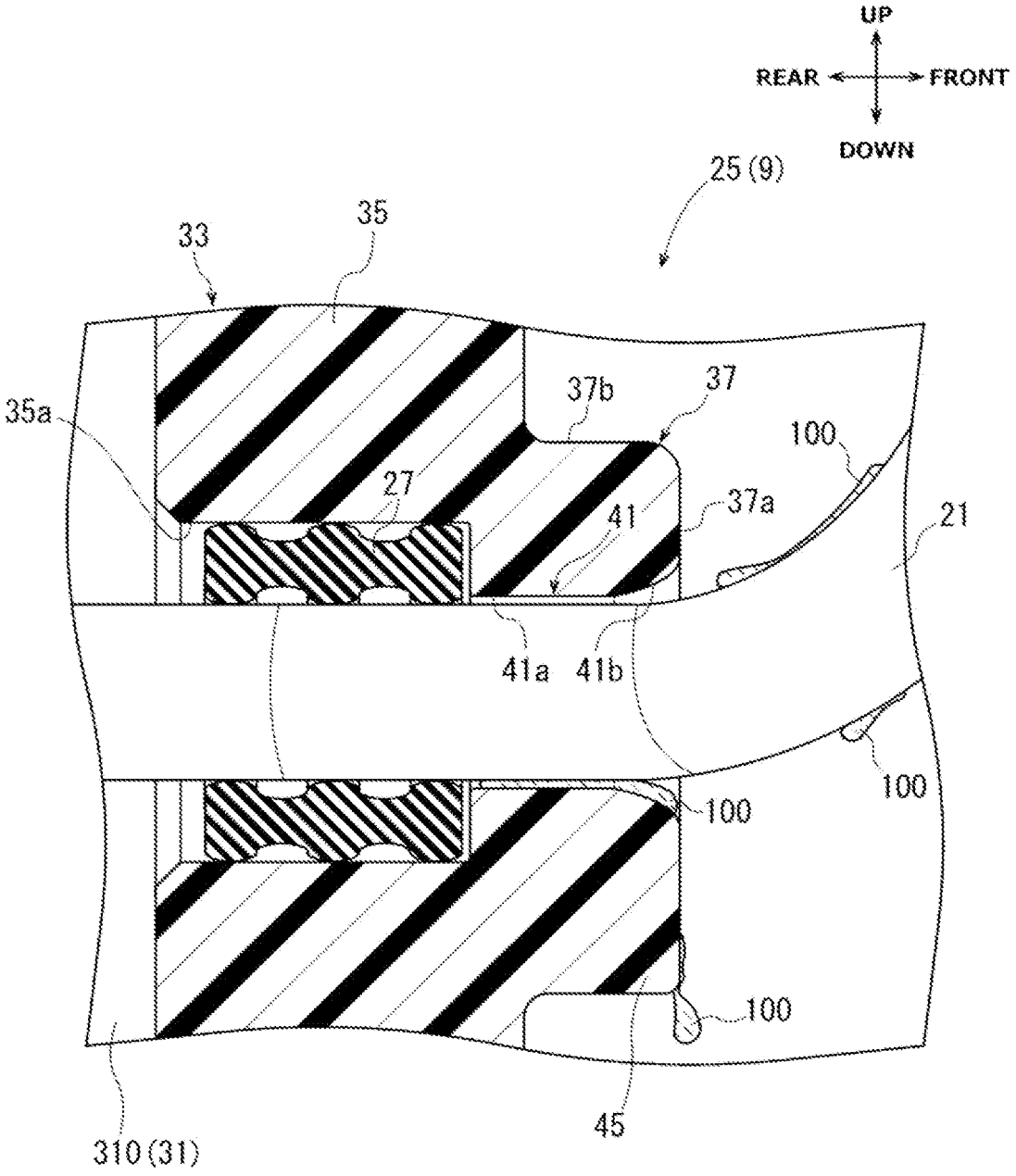
FIG. 6 is an enlarged sectional view of a main part of the electric compressor according to the first embodiment, taken along a line VI-VI of FIG. 4.

As illustrated in FIG. 6, the main body 35 has an accommodation chamber 35*a*. The accommodation chamber 35*a* is recessed in the front direction from a rear end of the main body 35. The main body 35 is fitted into the mounting opening 310, so that the accommodation chamber 35*a* is positioned inside the case 31. The accommodation chamber 35*a* has a grommet 27 serving as a sealing member. The grommet 27 is made of synthetic rubber. The grommet 27 may be made of any material other than the synthetic rubber.

Figure 4:
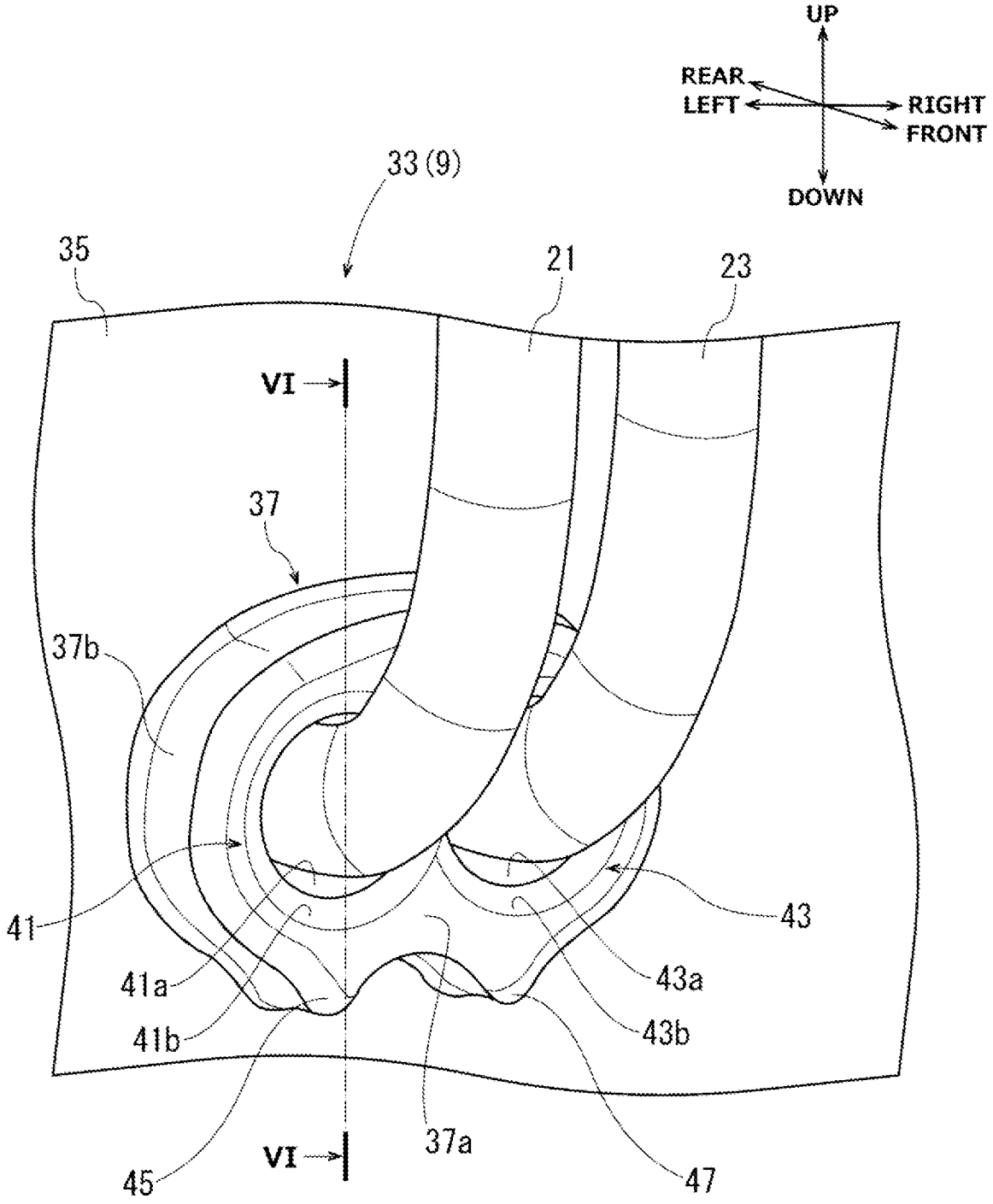
FIG. 4 is an enlarged perspective view of a main part of the electric compressor according to the first embodiment, illustrating the cables and protrusions.

As illustrated in FIG. 4, the first protrusion 37 is formed integrally with the main body 35 at a center portion thereof, and substantially elliptically protrudes forward from the main body 35. The first protrusion 37 has an end surface 37*a* and a side surface 37*b*. The end surface 37*a* is positioned at a front end of the first protrusion 37, i.e., the most front part of the cap 33. The end surface 37*a* is a flat surface. A pair of a first insertion hole 41 and a second insertion hole 43 are formed on the end surface 37*a*. Each of the first insertion hole 41 and the second insertion hole 43 is an example of an "insertion hole" of the present disclosure.

Figure 5:
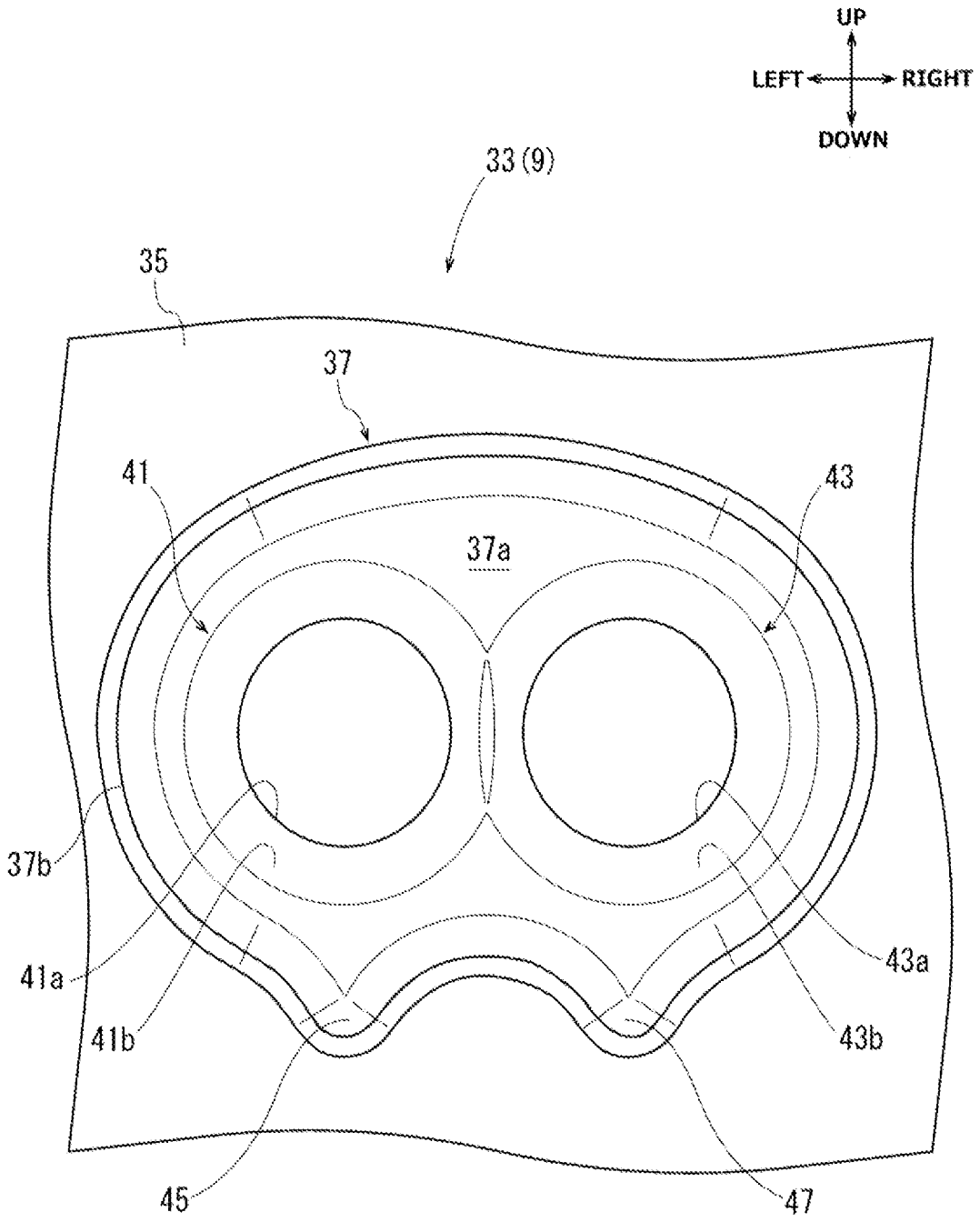
FIG. 5 is a front view of the protrusions in the electric compressor according to the first embodiment.

As illustrated in FIG. 5, the first insertion hole 41 and the second insertion hole 43 are spaced from each other in the right-left direction, and extend through the first protrusion 37 from the end surface 37*a*. As illustrated in FIG. 4, diameters of the first insertion hole 41 and the second insertion hole 43 are greater than those of the first power supply cable 21 and the second power supply cable 23, respectively. Thus, the first power supply cable 21 is inserted into the first insertion hole 41, and the second power supply cable 23 is inserted into the second insertion hole 43, respectively.

The first insertion hole 41 has a first linear portion 41*a* and a first tapered portion 41*b*. The second insertion hole 43 has a second linear portion 43*a* and a second tapered portion 43*b*. Each of the first tapered portion 41*b* and the second tapered portion 43*b* is an example of a "tapered portion" of the present disclosure.

The first linear portion 41*a* and the second linear portion 43*a* linearly extend through the first protrusion 37 in the front-rear direction. As illustrated FIG. 6, a rear end of the first linear portion 41*a* is connected to the accommodation chamber 35*a*. As with the first linear portion 41*a*, a rear end of the second linear portion 43*a* is also connected to the accommodation chamber 35*a* (not illustrated). Thus, the first insertion hole 41 and the second insertion hole 43 communicate with the accommodation chamber 35*a*.

As illustrated FIG. 4, the first tapered portion 41*b* is connected to a front end of the first linear portion 41*a*, and the second tapered portion 43*b* is connected to a front end of the second linear portion 43*a*. As a result, the first tapered portion 41*b* forms a front portion of the first insertion hole 41, and the second tapered portion 43*b* forms a front portion of the second insertion hole 43. A front end of each of the first tapered portion 41*b* and the second tapered portion 43*b* is connected to the end surface 37*a*.

As illustrated FIG. 6, a diameter of the first tapered portion 41*b* gradually increases from the first linear portion 41*a* (i.e., from an inside of the housing 1) toward the end surface 37*a*. Similarly, a diameter of the second tapered portion 43*b* gradually increases from the second linear portion 43*a* (i.e., from the inside of the housing 1) toward the end surface 37*a*. That is, the first tapered portion 41*b* and the second tapered portion 43*b* are connected to the end surface 37*a* at a position where the first tapered portion 41*b* and the second tapered portion 43*b* each have the largest diameter thereof.

As illustrated FIG. 4, the side surface 37*b* is positioned between the end surface 37*a* and the main body 35 and cylindrically extends in the front-rear direction. A front end of the side surface 37*b* is connected to the end surface 37*a*, and a rear end of the side surface 37*b* is connected to the main body 35. As described above, the side surface 37*b* connects the end surface 37*a* and the main body 35.

A pair of a one-side second protrusion 45 and an other-side second protrusion 47 is formed on the side surface 37*b* and formed integrally with the side surface 37*b*. Each of the one-side second protrusion 45 and the other-side second protrusion 47 is an example of a "second protrusion" of the present disclosure. For the sake of convenience, the one-side second protrusion 45 and the other-side second protrusion 47 are simply referred to as "second protrusions 45, 47" in the following description.

The second protrusions 45, 47 are spaced from each other in the right-left direction in the side surface 37*b*. Specifically, the second protrusion 45 is positioned directly below the first insertion hole 41 on the side surface 37*b* in the gravity direction. On the other hand, the second protrusion 47 is positioned directly below the second insertion hole 43 in the side surface 37*b* in the gravity direction. Since the end surface 37*a* is integrated with the side surface 37*b*, the second protrusions 45, 47 are integrated with a lower portion of the end surface 37*a* and continuous with the end surface 37*a*.

As illustrated in FIG. 5, the second protrusions 45, 47 are formed in the same shape. Specifically, the second protrusions 45, 47 extend downward from the side surface 37*b* and the end surface 37*a*. At this time, the second protrusions 45, 47 extend downward with respect to the side surface 37*b* surrounding the second protrusions 45, 47. As a result, lower ends of the second protrusions 45, 47 are each located at the lowest position in the first protrusion 37 including the side surface 37*b*.

The second protrusions 45, 47 are gradually tapered downward in the gravity direction from the first insertion hole 41 and the second insertion hole 43 in the end surface 37*a*, respectively. Thus, the second protrusions 45, 47 are tapered from the first insertion hole 41 and the second insertion hole 43 toward the lower ends of the second protrusions 45, 47 to each have a substantially triangular shape. In other words, the second protrusions 45, 47 are gradually narrowed in the right-left direction from proximal ends thereof being continuous with the side surface 37*b* and the end surface 37*a* toward distal ends thereof to each have the substantially triangular shape. As illustrated in FIG. 4, the length of each of the second protrusions 45, 47 in the front-rear direction is the same as that of the side surface 37*b* in the front-rear direction. Therefore, rear ends of the second protrusions 45, 47 are connected to the main body 35, respectively.

In the power supplier 9, the first power supply cable 21 and the second power supply cable 23 are connected to the inverter 7 at one end of each of the first power supply cable 21 and the second power supply cable 23, and inserted into the power supply connector 25. That is, the first power supply cable 21 and the second power supply cable 23 are inserted into the grommet 27 while entering the case 31. The first power supply cable 21 is inserted into the first insertion hole 41 and extends toward an outside of the first protrusion 37 from the end surface 37*a* of the first protrusion 37. Similarly, the second power supply cable 23 is inserted into the second insertion hole 43 and extends toward the outside of the first protrusion 37 from the end surface 37*a* of the first protrusion 37.

In the power supply connector 25, a first fastening bolt 71 and a second fastening bolt 73 are inserted into a first mounting hole 311 and a second mounting hole 312 of the case 31, respectively (see FIG. 2). The case 31 and thus the power supply connector 25 are fastened to the front case 17 with the first fastening bolt 71 and the second fastening bolt 73.

As a result, in the power supplier 9, the power supply connector 25 is fixed to the housing 1 including the inverter box 15. Then, the first protrusion 37 protrudes forward from the housing 1 (toward the outside of the housing 1). Furthermore, the first insertion hole 41 and the second insertion hole 43 communicate with the housing 1 including the inverter chamber 15*a* through the accommodation chamber 35*a* and the communication hole 150. The first power supply cable 21 and the second power supply cable 23 extend toward the outside of the housing 1 from the first insertion hole 41 and the second insertion hole 43. In a state where the first power supply cable 21 and the second power supply cable 23 are inserted into the power supply connector 25 in advance, the one end of each of the first power supply cable 21 and the second power supply cable 23 may be connected to the inverter 7. The power supply connector 25 may be fixed to the front case 17 using any method.

In the engine room of the vehicle, the other end of each of the first power supply cable 21 and the second power supply cable 23 is connected to the battery. The electric compressor of the present embodiment is disposed below the battery in the engine room. Therefore, the first power supply cable 21 and the second power supply cable 23 extend upward from the housing 1 and are connected to the battery. As described above, in the electric compressor of the present embodiment, the inverter 7 and the battery are electrically connected to each other via the power supplier 9.

In the electric compressor of the present embodiment, one end of a control cable (not illustrated) is connected to the control connector 61. The other end of the control cable is connected to a controller of the vehicle (not illustrated). As a result, in the electric compressor of the present embodiment, the inverter 7 and the controller are electrically connected to each other.

In the above-described electric compressor of the present embodiment, electric power is supplied from the battery to the inverter 7 through the first power supply cable 21 and the second power supply cable 23. A control signal is transmitted from the controller to the inverter 7 through the control cable connected to the control connector 61. Thus, the inverter 7 controls and drives the motor mechanism 5 while supplying the power to the motor mechanism 5. As a result, the motor mechanism 5 drives the compression mechanism 3. In the compression mechanism 3, refrigerant gas having flowed into the motor housing 13 from the inlet is drawn and compressed, and the compressed refrigerant gas is discharged into the discharge chamber. The refrigerant gas discharged into the discharge chamber is discharged to the outside of the housing 1 from the outlet provided in the compressor housing 11.

In the electric compressor of the present embodiment, the first power supply cable 21 and the second power supply cable 23 extend toward the outside of the housing 1 and are connected to the battery. Then, a water droplet 100 (see FIG. 6) having entered the engine room may adhere to the first power supply cable 21 and the second power supply cable 23. The water droplet 100 having adhered to the first power supply cable 21 and the second power supply cable 23 may move toward the first protrusion 37, and thus toward the first insertion hole 41 and the second insertion hole 43 along the first power supply cable 21 and the second power supply cable 23.

In particular, the electric compressor of the present embodiment is disposed below the battery in the engine room, and the first power supply cable 21 and the second power supply cable 23 extend upward from the housing 1 and are connected to the battery. Therefore, due to the gravity, the water droplet 100 having adhered to the first power supply cable 21 and the second power supply cable 23 easily moves toward the first insertion hole 41 and the second insertion hole 43 along the first power supply cable 21 and the second power supply cable 23. Examples of the water droplet 100 include rainwater, water for washing a car, muddy water during driving, and the like. The water droplet 100 may contain impurities such as salt in the air, lubricating oil in the engine room, and mud on a road.

The first insertion hole 41 and the second insertion hole 43 communicate with the inverter chamber 15*a*, and the first power supply cable 21 and the second power supply cable 23 are connected to the inverter 7. Thus, a short circuit, corrosion, and the like may occur in the inverter 7 when the water droplet 100 enters the inverter chamber 15*a* from the first insertion hole 41 and the second insertion hole 43 and then adheres to the inverter 7.

In the electric compressor of the present embodiment, even when the water droplet 100 moves into the first insertion hole 41 and the second insertion hole 43 along the first power supply cable 21 and the second power supply cable 23, the water droplet 100 hardly enter the inverter chamber 15*a* from the first insertion hole 41 and the second insertion hole 43.

That is, in the electric compressor of the present embodiment, the water droplet 100 moves into the first insertion hole 41 along the first power supply cable 21 and reaches a position between an inner surface of the first insertion hole 41 and the first power supply cable 21. Similarly, the water droplet 100 moves into the second insertion hole 43 along the second power supply cable 23 and reaches a position between an inner surface of the second insertion hole 43 and the second power supply cable 23.

In the electric compressor of the present embodiment, the accommodation chamber 35*a* is provided in the main body 35 of the cap 33 and accommodates the grommet 27. The first power supply cable 21 and the second power supply cable 23 are inserted into the grommet 27. Thus, the grommet 27 is positioned in the rear of the first insertion hole 41 and the second insertion hole 43, and seals a position between the grommet 27 and an inner wall of the accommodation chamber 35*a*, a position between the grommet 27 and the first insertion hole 41, and a position between the grommet 27 and the second insertion hole 43.

Therefore, the water droplet 100 having moved into the first insertion hole 41 and the second insertion hole 43 hardly moves rearward inside the first insertion hole 41 and the second insertion hole 43. As a result, the water droplet 100 inside the first insertion hole 41 and the second insertion hole 43 moves through the first tapered portion 41*b* and the second tapered portion 43*b* and then moves out to the end surface 37*a* of the first protrusion 37.

The water droplet 100 moved out to the end surface 37*a* moves downward due to the gravity applied to the housing 1 including the first protrusion 37. Here, the second protrusions 45, 47 are provided on the side surface 37*b* of the first protrusion 37, and extend downward from the end surface 37*a*. Thus, the water droplet 100 moves downward on the end surface 37*a* and is guided to the second protrusions 45, 47. Then, the water droplet 100 guided to the second protrusions 45, 47 moves toward the lower ends of the second protrusions 45, 47.

As described above, the second protrusions 45, 47 guides the water droplet 100 from the lower ends of the second protrusions 45, 47 to the outside of the first protrusion 37 and the outside of the housing 1. That is, the second protrusions 45, 47 allows the water droplet 100 to drip toward the outside of the housing 1 from the lower ends of the second protrusions 45, 47.

As described above, in the electric compressor of the present embodiment, even when the water droplet 100 moves into the first insertion hole 41 and the second insertion hole 43 along the first power supply cable 21 and the second power supply cable 23, the second protrusions 45, 47 guide the water droplet 100 to the outside of the housing 1. In the electric compressor of the present embodiment, the second protrusions 45, 47 guide the water droplet 100 to the outside of the housing 1, which prevents the water droplet 100 having moved from the first insertion hole 41 and the second insertion hole 43 toward the end surface 37*a* from moving into the first insertion hole 41 and the second insertion hole 43 again due to vibration during a travel of the vehicle.

As a result, in the electric compressor of the present embodiment, even when the water droplet 100 reaches the first insertion hole 41 and the second insertion hole 43 along the first power supply cable 21 and the second power supply cable 23, the water droplet 100 hardly enters the inverter box 15 through the first insertion hole 41 and the second insertion hole 43. Thus, in the electric compressor of the present embodiment, the short circuit and the corrosion due to the water droplet 100 hardly occur in the inverter 7.

Due to vibration during the travel of the vehicle, part of the water droplet 100 moving along the first power supply cable 21 and the second power supply cable 23 may be dropped on the end surface 37*a* from the first power supply cable 21 and the second power supply cable 23 before reaching the first insertion hole 41 and the second insertion hole 43. Furthermore, in the electric compressor of the present embodiment, the water droplet 100 may directly adhere to the end surface 37*a* without moving along the first power supply cable 21 and the second power supply cable 23.

However, in the electric compressor of the present embodiment, the above-described water droplet 100 is also guided to the second protrusions 45, 47 along the end surface 37*a*, and then guided to the outside of the housing 1 along the second protrusions 45, 47. Therefore, in the electric compressor of the present embodiment, in addition to the water droplet 100 having dropped on the end surface 37*a* from the first power supply cable 21 and the second power supply cable 23 before reaching the first insertion hole 41 and the second insertion hole 43, the water droplet 100 having adhered to the end surface 37*a* without moving along the first power supply cable 21 and the second power supply cable 23 also hardly enters the inverter box 15 through the first insertion hole 41 and the second insertion hole 43.

The second protrusions 45, 47 are formed integrally with the side surface 37*b* of the first protrusion 37. Thus, in the electric compressor of the present embodiment, an increase in the number of parts of the power supply connector 25 is suppressed even when the second protrusions 45, 47 are provided. In the electric compressor of the present embodiment, the second protrusions 45, 47 are formed integrally with the side surface 37*b*, so that works for forming the second protrusions 45, 47 on the side surface 37*b* are not required.

Therefore, in the electric compressor of the present embodiment, it is possible to suitably prevent the inverter 7 from being damaged due to the water droplet 100 and to suppress an increase in a manufacturing cost.

In particular, in the electric compressor of the present embodiment, the grommet 27 stopping water allows the water droplet 100 inside the first insertion hole 41 and the second insertion hole 43 to easily move to the end surface 37*a* and suitably prevents the water droplet 100 inside the first insertion hole 41 and the second insertion hole 43 from moving rearward.

As described above, the water droplet 100 inside the first insertion hole 41 and the second insertion hole 43 is guided to the second protrusions 45, 47 via the end surface 37*a*, so that the water droplet 100 hardly remains in the first insertion hole 41 and the second insertion hole 43. As a result, in the electric compressor of the present embodiment, the grommet 27 and the water droplet 100 are prevented from coming in contact with each other for a long period of time, which suitably prevents the grommet 27 from deteriorating due to salt and the like contained in the water droplet 100.

In the electric compressor of the present embodiment, the second protrusion 45 is positioned directly below the first insertion hole 41 in the gravity direction, and the second protrusion 47 is positioned directly below the second insertion hole 43 in the gravity direction. Thus, in the electric compressor of the present embodiment, the water droplet 100 moves from the first insertion hole 41 toward the end surface 37*a* and suitably moves along the end surface 37*a* toward the second protrusion 45, and the water droplet 100 moves from the second insertion hole 43 toward the end surface 37*a* and suitably moves along the end surface 37*a* toward the second protrusion 47. As a result, in the electric compressor of the present embodiment, the water droplet 100 having reached the first insertion hole 41 and the water droplet 100 having reached the second insertion hole 43 are suitably guided to the second protrusions 45, 47, respectively. Then, the second protrusions 45, 47 suitably guide the water droplet 100 to the outside of the housing 1.

Furthermore, the second protrusions 45, 47 each have the substantially triangular shape gradually tapered from the first insertion hole 41 and the second insertion hole 43 toward the lower ends of the second protrusions 45, 47, respectively. Thus, in the electric compressor of the present embodiment, the water droplet 100 moving downward along the end surface 37*a* is likely to be guided to the second protrusions 45, 47. In the electric compressor of the present embodiment, the water droplet 100 is likely to be dripped toward the outside of the housing 1 from the lower ends of the second protrusions 45, 47.

The first insertion hole 41 includes the first tapered portion 41*b*. The second insertion hole 43 includes the second tapered portion 43*b*. The diameters of the first tapered portion 41*b* and the second tapered portion 43*b* gradually increase from the first linear portion 41*a* and the second linear portion 43*a* toward the end surface 37*a*. Thus, in the electric compressor of the present embodiment, the water droplet 100 inside the first insertion hole 41 easily moves toward the end surface 37*a* along the first tapered portion 41*b*, and the water droplet 100 inside the second insertion hole 43 easily moves toward the end surface 37*a* along the second tapered portion 43*b*. That is, in the electric compressor of the present embodiment, the water droplet 100 having moved into the first insertion hole 41 suitably moves along the first tapered portion 41*b* toward the end surface 37*a* and thus toward the second protrusion 45, and the water droplet 100 having moved into the second insertion hole 43 suitably moves along the second tapered portion 43*b* toward the end surface 37*a* and thus toward the second protrusion 47. In this respect, in the electric compressor of the present embodiment, the water droplet 100 hardly enters the inverter box 15 through the first insertion hole 41 and the second insertion hole 43.

In the electric compressor of the present embodiment, the first tapered portion 41*b* and the second tapered portion 43*b* prevent the first power supply cable 21 inserted into the first insertion hole 41 and the second power supply cable 23 inserted into the second insertion hole 43 from being sharply bent upward from the first protrusion 37. Thus, in the electric compressor of the present embodiment, breakage of the first power supply cable 21 and the second power supply cable 23 is suitably prevented.

Second Embodiment

Figure 7:
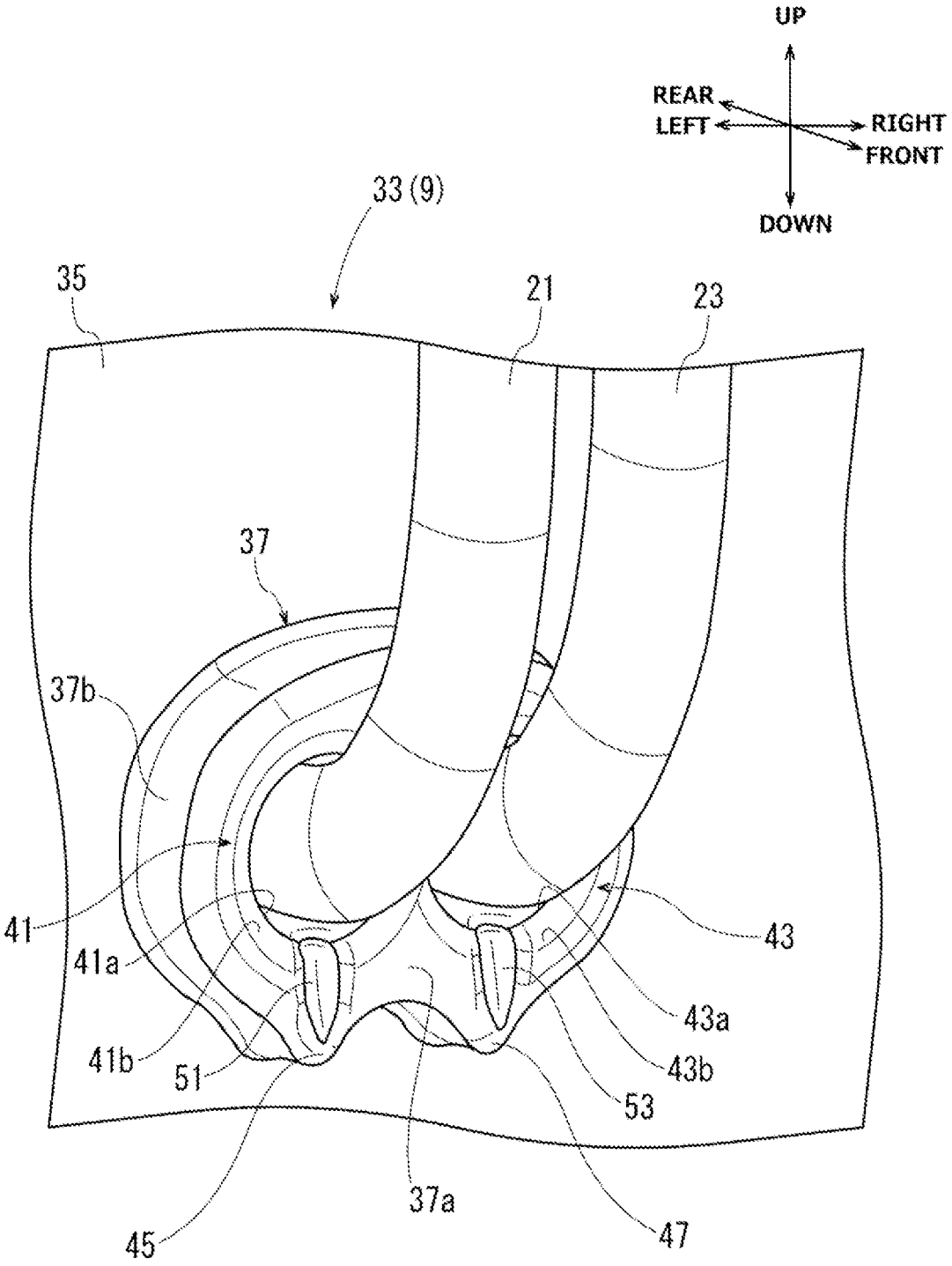
FIG. 7 is an enlarged sectional view of a main part of an electric compressor according to a second embodiment, illustrating cables and protrusions.

As illustrated in FIG. 7, in an electric compressor of a second embodiment, a first groove 51 and a second groove 53 are formed integrally with the end surface 37*a* of the first protrusion 37. Each of the first groove 51 and the second groove 53 is an example of a "groove" of the present disclosure.

The first groove 51 and the second groove 53 have the same shape and are recessed in the end surface 37*a*. The first groove 51 is positioned below the first insertion hole 41 in the end surface 37*a* and extends in the up-down direction. On the other hand, the second groove 53 is positioned below the second insertion hole 43 in the end surface 37*a* and extends in the up-down direction. Specifically, an upper end of the first groove 51 is connected to the first insertion hole 41 along the first tapered portion 41*b*, and extends toward the second protrusion 45 in a downward direction. An upper end of the second groove 53 is connected to the second insertion hole 43 along the second tapered portion 43*b*, and extends toward the second protrusion 47 in a downward direction. Other components of the second embodiment are the same as those of the first embodiment, and components of the second embodiment corresponding to those of the first embodiment are designated by the same reference numerals and are not described in detail.

In the electric compressor of the present embodiment, the water droplet 100 moves from the first insertion hole 41 and the second insertion hole 43 toward the end surface 37*a*, and then moves along the first groove 51 and the second groove 53. Thus, the first groove 51 guides the water droplet 100 toward the second protrusion 45, and the second groove 53 guides the water droplet 100 toward the second protrusion 47. In the electric compressor of the present embodiment, the water droplet 100 inside the first insertion hole 41 is suitably guided to the second protrusion 45, and the water droplet 100 inside the second insertion hole 43 is suitably guided to the second protrusion 47. As a result, in the electric compressor of the present embodiment, the water droplet 100 inside the first insertion hole 41 and the second insertion hole 43 more hardly enter the inverter chamber 15*a*.

Since the first groove 51 and the second groove 53 are formed integrally with the end surface 37*a*, an increase in the number of parts of the power supply connector 25 is suppressed in the electric compressor of the present embodiment. Then, in the electric compressor of the present embodiment, works for forming the first groove 51 and the second groove 53 in the end surface 37*a* are not required. Other operations of the electric compressor of the second embodiment are the same as those of the electric compressor of the first embodiment.

Although the present disclosure has been described according to the first embodiment and the second embodiment, the above-described embodiments may be appropriately modified within the scope of the present disclosure.

For example, in the electric compressor of the first embodiment, although the second protrusions 45, 47 are formed in the side surface 37*b* of the first protrusion 37, the second protrusion 47 need not be formed or a guide portion may be formed in addition to the second protrusions 45, 47. The same applies to the second embodiment.

In the electric compressor of the first embodiment, the first power supply cable 21 and the second power supply cable 23 are inserted into the first insertion hole 41 and the second insertion hole 43, respectively. However, the second insertion hole 43 need not be formed, and both the first power supply cable 21 and the second power supply cable 23 may be inserted into the first insertion hole 41. In this case, the first power supply cable 21 and the second power supply cable 23 may be formed integrally with each other. The same applies to the second embodiment.

In the electric compressor of the first embodiment, the communication hole 150 may be formed in the rear case 19, and the power supply connector 25 may be fixed to the rear case 19. The same applies to the second embodiment.

The compression mechanism 3 may be any compression mechanism such as a vane compression mechanism, a swash plate compression mechanism, or a centrifugal compression mechanism.

In the compression mechanism 3, fluid other than refrigerant gas, such as air or hydrogen for pumping to the fuel cell, may be drawn and discharged. That is, the compression mechanism 3 may be used for a fuel cell vehicle.

INDUSTRIAL APPLICABILITY

The present disclosure is applicable to electric equipment such as a vehicle electric compressor.

What is claimed is:

1. An electric compressor comprising:

a compression mechanism configured to compress fluid that is drawn and discharge the compressed fluid;

a motor mechanism configured to drive the compression mechanism;

an inverter configured to control and drive the motor mechanism;

a housing accommodating the compression mechanism, the motor mechanism, and the inverter; and a power supplier configured to supply electric power to the inverter, wherein the power supplier includes a cable that is connected to the inverter and extends toward an outside of the housing, and a connector fixed to the housing, the connector includes a first protrusion extending toward the outside of the housing, the first protrusion includes an end surface that has an insertion hole into which the cable is inserted, and a side surface that cylindrically extends and is connected to the end surface, a second protrusion is formed integrally with the side surface and extends downward from the side surface in a gravity direction corresponding to a direction in which the gravity is applied to the housing, the second protrusion being integrated with a lower portion of the end surface, and a water droplet having reached the insertion hole along the cable is guided from the insertion hole to the second protrusion along the end surface, wherein the cable includes a pair of cables, the insertion hole includes a pair of insertion holes, each of the pair of the cables is inserted into a corresponding one of the pair of the insertion holes, the second protrusion includes a pair of second protrusions, each of the pair of second protrusions is gradually tapered downward in the gravity direction from the corresponding one of the pair of insertion holes, as viewed from a front of the connector, and a recess is located between the pair of the second protrusions as viewed from the front of the connector, the recess being recessed upward from the side surface of the first protrusion in a direction opposite to the gravity direction.

2. The electric compressor according to claim 1, wherein each of the pair of the second protrusions is positioned directly below a corresponding one of the pair of the insertion holes in the gravity direction.

3. The electric compressor according to claim 1, wherein the end surface has a groove extending toward each of the pair of the second protrusions from the respective insertion holes.

4. The electric compressor according to claim 1, wherein each of the insertion holes has a tapered portion, and a diameter of the tapered portion gradually increases from an inside of the housing toward the end surface.

5. The electric compressor according to claim 1, wherein the side surface cylindrically extends in a front-rear direction of the connector, and the end surface is located at a front end of the first protrusion, wherein the front end is a portion of the first protrusion that is located furthermost from the housing as viewed in the front-rear direction.

* * * * *